US007395766B2

(12) United States Patent
Landwehr et al.

(10) Patent No.: US 7,395,766 B2
(45) Date of Patent: Jul. 8, 2008

(54) VALUABLES CASE FOR HOLDING SECURITIES WITH A SAFETY DEVICE

(75) Inventors: Martin Landwehr, Paderborn (DE); Juergen Schlueter, Schlangen (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 10/589,219

(22) PCT Filed: Feb. 5, 2005

(86) PCT No.: PCT/DE2005/000203

§ 371 (c)(1),
(2), (4) Date: Aug. 11, 2006

(87) PCT Pub. No.: WO2005/078225

PCT Pub. Date: Aug. 25, 2005

(65) Prior Publication Data

US 2007/0163987 A1 Jul. 19, 2007

(30) Foreign Application Priority Data

Feb. 17, 2004 (DE) ..... 10 2004 007 581

(51) Int. Cl.
*E05G 1/00* (2006.01)
*G08B 15/00* (2006.01)

(52) U.S. Cl. ..... 109/25; 109/36

(58) Field of Classification Search ..... 109/25, 109/29–34, 20, 36, 37, 39, 41, 43
See application file for complete search history.

(56) References Cited

U.S. PATENT DOCUMENTS 4,799,435 A 1/1989 Boutroy ..... 109/25

(Continued)

FOREIGN PATENT DOCUMENTS

AT E 42794 B 9/1989

(Continued)

OTHER PUBLICATIONS

English Language Translation of the International Search Report for PCT/DE2005/000203, ISA/EP, Rijswijk, NL, mailed Aug. 1, 2005.

(Continued)

*Primary Examiner*—Patricia Engle
*Assistant Examiner*—Alyson M Merlino
(74) *Attorney, Agent, or Firm*—Harness, Dickey & Pierce, P.L.C.

(57) ABSTRACT

A valuables case (1) for holding securities with a safety device having at least one holding chamber (5, 6) for an ink and having a measuring and triggering device for registering at least one parameter of the valuables case and for releasing the liquid from the holding chamber (5, 6) into the valuables container on the basis of the measured parameter is distinguished by at least one vibration generator (14) associated with the safety device for the purpose of generating vibrations in the liquid (7) in the at least one holding chamber. In this context, the measuring and triggering device is designed to register at least one vibration parameter and to release the liquid from the holding chamber (5, 6) into the interior (2) on the basis of the measured vibration parameter.

17 Claims, 1 Drawing Sheet

U.S. PATENT DOCUMENTS

| | | | | |
|---|---|---|---|---|
| 4,852,502 | A | 8/1989 | Klingberg et al. | 109/25 |
| 5,617,799 | A | 4/1997 | Kaczorowski | 109/29 |
| 6,536,348 | B1 | 3/2003 | Gral | 102/293 |
| 6,564,726 | B1 | 5/2003 | Lindskog | |
| 7,100,520 | B2 | 9/2006 | Abe et al. | 109/25 |
| 2002/0033083 | A1 | 3/2002 | Claesson et al. | 82/118 |
| 2003/0116641 | A1 | 6/2003 | Ohnishi et al. | 239/102.1 |
| 2004/0154500 | A1 | 8/2004 | Richard et al. | 109/25 |

FOREIGN PATENT DOCUMENTS

| | | | |
|---|---|---|---|
| AT | E72349 | B | 10/1992 |
| DE | 399790 | C | 7/1924 |
| DE | 3025853 | A1 | 1/1981 |
| DE | 69419068 | T2 | 11/1999 |
| EP | 0347091 | A2 | 12/1989 |
| FR | 2385873 | A | 10/1978 |
| FR | 2401297 | A | 3/1979 |
| GB | 1492706 | A | 11/1977 |
| GB | 2249651 | A | 5/1992 |

OTHER PUBLICATIONS

Written Opinion of the ISA for PCT/DE2005/000203, ISA/EP, Rijswijk, NL, mailed Aug. 1, 2005 (in German).

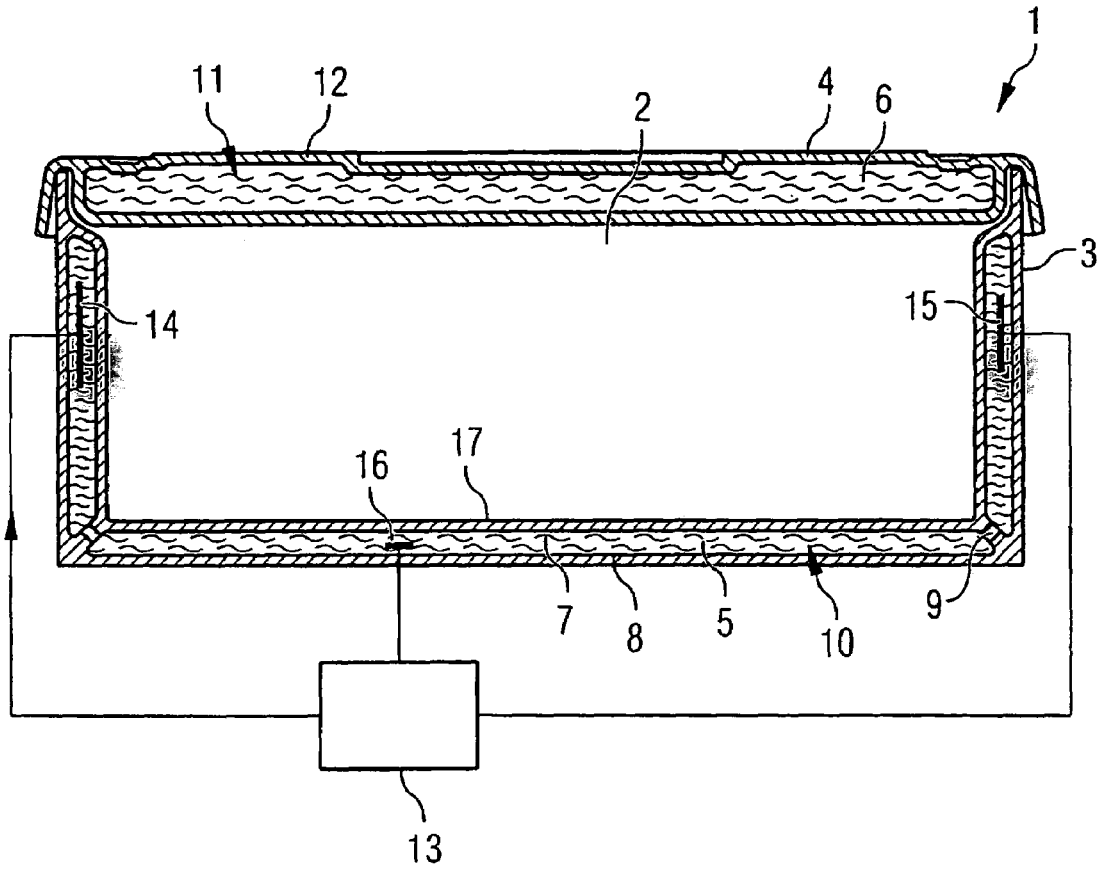
1
11
12
2
4
6
3
14
15
16
17
7
8
5
10
9
13

VALUABLES CASE FOR HOLDING SECURITIES WITH A SAFETY DEVICE

The invention relates to a valuables case for holding securities with a safety device, having a holding chamber for a liquid, particularly an ink, and having a measuring and triggering device for registering at least one parameter of the valuables case and for triggering the release of the liquid from the holding chamber into the interior on the basis of the measured parameter.

Such valuables cases with safety devices are known per se. The known system are of relatively complex design, however, since they are generally fitted as retrofit systems, which need to be fitted into existing cases retrospectively. The liquid—which is in the form of an ink, for example, such that it makes the stolen securities in the valuables case unusable in the event of an attempt at breaking it open—is generally put into a separate container which is inserted into the valuables case. In this context, the geometry of the valuables case needs to be designed such that the liquid can flow directly into the securities, which has associated problems.

To trigger the outflow of the liquid, it is known practice to measure parameters of the system, such as the temperature or a resistance, and to trigger the outflow of the ink if there is a significant discrepancy from a nominal value. Although this practice has been proven per se, it is desirable to develop the safety device further such that it also reacts reliably to just slight alterations in parameters, which indicate an attempt at breaking the case open, while being of simple design.

The solution to this problem is the object of the invention.

The safety device has at least one associated vibration generator for generating vibrations in the liquid in the at least one holding chamber, and the measuring and triggering device is designed to register at least one vibration parameter and to release the liquid from the holding chamber into the valuables container on the basis of the measured vibration parameter.

This refinement has the following advantage: an alteration in properties in the "valuables case with liquid" vibration and resonance system may be brought about by a change in volume, pressure and/or temperature, for example, in the attempt at breaking the case open. This alteration in properties also results in a change in the vibration parameters, these being able to be registered and evaluated much more reliably than is possible in the case of direct registration—e.g. of the parameters cited at the outset in the description of the prior art.

In accordance with one advantageous refinement, the at least one holding chamber is in a form, on all sides of the housing of the valuables case, such that it is not possible to penetrate the wall structure through to the interior of the valuables case using a tool without penetrating the at least one or one of the holding chambers. This refinement makes it easier to ensure that the entire content of the valuables case is always reached by the liquid which is to be introduced in the attempt at breaking the case open and makes it easier to measure the vibration parameters reliably.

Expediently, the measuring and triggering device has an associated measuring and control computer, and this in turn has an associated vibration generator and an associated sensor element in the at least one holding chamber, in order to produce and register the vibrations which are to be measured.

In this context, it is appropriate for reasons of cost and in order to ensure a high level of functional reliability if the at least one vibration generator and/or the sensor element are in the form of a piezoactuator, particularly in the form of a piezofoil.

The invention is described in more detail below using an exemplary embodiment with reference to the drawing, in which:

FIG. 1 shows a sectional view through a simplified schematic illustration of a valuables container.

FIG. 1 shows a valuables case 1 for holding securities (not shown here) in the interior 2 of the valuables case. In this arrangement, the valuables case 1 comprises a base container 3 and a lid 4 sealing the base container 3.

Both the base container 3 and the lid 4 are respectively provided with holding chambers 5, 6 for a liquid 7 such as ink. The holding chamber 5 in the base container 3 is preferably designed such that no side provides a straight path to the interior 2, which means that it is not possible to use a needle or a small hook, for example, to penetrate the wall 8 of the valuables container in order to steal the securities.

This is achieved in this context by virtually the entire wall 8 apart from small webs 9, for example, being in the form of a double wall with an interior cavity 10 which is filled with the ink and forms a holding chamber 5. The wall 12 of the lid 4 has a corresponding design as a double wall with an interior cavity 11. The interior cavities 10 and 11 of the valuables case housing which is made of thermoplastic, in particular, can be filled with the liquid 7 directly during manufacture, so that manufacture is favorable.

Even if the sketch in FIG. 1 shows it to be theoretically possible to get into the interior on a straight path in the edge region between the lid 4 and the base container 3, for example, this can easily be prevented by an overlap in the chambers 5, 6 in this region in practice. It is also conceivable, by way of example, to arrange the lid 4 so as to be able to pivot on the base container 3 (not shown here) and to connect the holding chambers 5 and 6 in the lid and in the base container 3 to one another so that the flow can take place. In this regard, the illustration in FIG. 1 is to be understood to be more schematic and serves to illustrate the principle of the invention.

Besides the holding chambers 5, 6, the safety device to prevent unauthorized withdrawal of the securities from the valuables case has a measuring and triggering device (shown purely schematically here) which is used to register at least one parameter of the valuables case 1 and trigger the release of the liquid 7 from the holding chambers 5, 6 into the interior 2 of the valuables container 1 on the basis of the measured parameter.

In this arrangement, the measuring and triggering device comprises a measuring and control computer 13 which is connected firstly to at least one vibration generator 14 in the holding chamber 5, which vibration generator is designed to produce vibrations in the liquid 7 in the holding chamber 5, and secondly to a sensor 15, which is likewise arranged in the holding chamber 5 and is used to register at least one vibration parameter.

The measuring and control computer 13—for example a compact computer unit with a microprocessor—may also be integrated directly in the valuables container 1.

To trigger the outflow of the ink 7 into the interior 2, the interior is connected to a small explosive charge 16 which is designed to destroy the inner wall 17 of the double wall when triggered, so that the ink flows out into the interior 2.

A corresponding arrangement may be arranged in the lid 4 (not shown here). When there are a plurality of holding chambers 5, 6, each of these chambers may contain a vibration generator, a sensor and an explosive charge, the measuring and control computer 13 being provided only once. Suitable explosive charges are actuators, such as are known in principle for example from airbag systems in vehicles, so that it is ensured that the inner wall is destroyed over a large area. However, they may also be $CO_2$ cartridges or a shape memory metal.

Suitable vibration generators 14 are, in particular, piezoactuators, e.g. piezofilms, which can simultaneously also form the sensors 15 or can be used as sensors 15 for the characteristic vibrations which are produced from the "ink/valuables case" resonance system. The piezofilms may be arranged (not shown here) just on one subregion or preferably on all the walls of the valuables case—apart from functional regions for authorized withdrawal in the assembled state in a higher-level machine, such as a cash machine.

The invention claimed is:

1. A valuables case having an interior for holding securities, comprising:

a safety device having:

at least one holding chamber for a liquid, particularly an ink, and a measuring and triggering device for monitoring at least one parameter of the valuables case and for triggering release of the liquid from the holding chamber into the interior on the basis of a change in the at least one parameter, and at least one vibration generator associated with the safety device for generating vibrations in the liquid in the at least one holding chamber, a sensor element, wherein the at least one vibration generator and the sensor element are arranged in the at least one holding chamber;

wherein the measuring and triggering device is designed to monitor vibrations generated by the vibration generator and to release the liquid from the holding chamber into the interior based on a change in vibrations.

2. The valuables case as claimed in claim 1, wherein the at least one holding chamber surrounds the interior, such that it is not possible to penetrate walls of the valuables case through to the interior using a tool without penetrating the at least one holding chamber.

3. The valuables case as claimed in claim 1, wherein the measuring and triggering device has a measuring and control computer.

4. The valuables case as claimed in claim 1, wherein each of the at least one vibration generator and the sensor element is a piezoactuator.

5. The valuables case as claimed in claim 4 wherein the piezoactuator is a piezofilm.

6. The valuables case as claimed in claim 1, wherein the at least one holding chamber is defined by a pair of walls that define an interior cavity.

7. The valuables case as claimed in claim 1, wherein the valuables case has a base container and a lid sealing the base container.

8. The valuables case as claimed in claim 1, wherein the valuables case is produced using a thermoplastic method.

9. A valuables case having an interior for holding securities, comprising:

a safety device having at least one holding chamber for a liquid, and a measuring and triggering device for monitoring at least one parameter of the valuables case and for triggering release of the liquid from the holding chamber into the interior on the basis of a change in the at least one parameter;

at least one vibration generator disposed in the holding chamber for generating vibrations in the liquid in the at least one holding chamber; and a sensor element disposed in the at least one holding chamber;

wherein the measuring and triggering device is designed to monitor vibrations generated by the vibration generator and to release the liquid from the holding chamber into the interior based on a change in vibrations.

10. The valuables case as claimed in claim 9, wherein the at least one holding chamber surrounds the interior such that it is not possible to penetrate walls of the valuables case through to the interior using a tool without penetrating the at least one holding chamber.

11. The valuables case as claimed in claim 9, wherein the measuring and triggering device has a measuring and control computer.

12. The valuables case as claimed in claim 9, wherein each of the at least one vibration generator and the sensor element is a piezoactuator.

13. The valuables case as claimed in claim 12, wherein the piezoactuator is a piezofilm.

14. The valuables case as claimed in claim 9, wherein the at least one holding chamber is defined by a pair of walls that define an interior cavity.

15. The valuables case as claimed in claim 9, wherein the valuables case has a base container and a lid sealing the base container.

16. The valuables case as claimed in claim 9, wherein the valuables case is produced using a thermoplastic method.

17. The valuables case as claimed in claim 1, wherein the at least one parameter is at least one of a volume, pressure, and temperature.

* * * * *